US005341150A

United States Patent [19]

Joy

[11] Patent Number: 5,341,150

[45] Date of Patent: Aug. 23, 1994

[54] LOW SIDELOBE REFLECTOR

[75] Inventor: Edward B. Joy, Stone Mountain, Ga.

[73] Assignee: Georgia Tech Research Corp., Atlanta, Ga.

[21] Appl. No.: 656,285

[22] Filed: Feb. 14, 1991

Related U.S. Application Data

[63] Continuation-in-part of Ser. No. 250,437, Sep. 28, 1988, abandoned.

[51] Int. Cl.[5] ..... H01Q 15/14

[52] U.S. Cl. ..... 343/912; 343/840

[58] Field of Search ..... 343/781 R, 703, 912–914, 343/840; H01Q 15/14

[56] References Cited

U.S. PATENT DOCUMENTS

| | | | |
|---|---|---|---|
| 2,543,130 | 2/1951 | Robertson | 343/912 |
| 3,140,491 | 7/1964 | Ashbaugh et al. | 343/912 |
| 3,599,219 | 8/1971 | Holtum et al. | 343/912 |
| 4,249,183 | 2/1981 | Bui Hai | 343/781 R |
| 4,651,160 | 3/1987 | Bornkast et al. | 343/914 |

FOREIGN PATENT DOCUMENTS

| | | | |
|---|---|---|---|
| 134959 | 10/1979 | Japan | 343/914 |
| 30239 | 3/1980 | Japan | 343/840 |

*Primary Examiner*—Michael C. Wimer

*Attorney, Agent, or Firm*—Deveau, Colton & Marquis

[57] ABSTRACT

A low sidelobe reflector for improving the test zone performance of compact ranges by shaping the edge serrations of the range reflector. The serrations provide a means for synthesizing desired illumination function tapers at the transition region near the edge of a reflector to provide low edge diffraction. Serrations with length greater than ten wavelengths and with a flower petal shape produce the least diffraction of energy into the quiet zone.

10 Claims, 29 Drawing Sheets

LOW SIDELOBE REFLECTOR

STATEMENT OF GOVERNMENT INTEREST

The invention described herein was made with Government support under contract numbers DAEA18-84-C-0050 and DAAG-29-84-K-0024 from the United States Army and Joint Services Electronics Program respectively. The Government has certain rights in this invention.

CROSS-REFERENCE TO RELATED APPLICATION

This application is a continuation-in-part of my prior application Ser. No. 07/250,437, filed Sep. 28, 1988, now abandoned.

BACKGROUND OF THE INVENTION

This invention relates generally to antenna systems, and more particularly to the use of shaped serrated edges reflector surfaces to optimize electromagnetic scattering in off-axis directions and to enhance electromagnetic scattering in the on-axis direction. The shaped, serrated edges can be used with center-fed or offset-fed parabolic and quasi-parabolic dish reflectors and cylindrical, spherical arid planar reflectors used for antennas or with compact ranges.

The present abrupt or irregular edge shapes cause high scattering of electromagnetic energy in off-axis regions resulting in high sidelobe levels for antenna and reflector application, or large amplitude ripples in the quiet zone for compact range applications.

The field reflected from a parabolic main reflector surface stops abruptly at the surface termination. The diffracted field emanating from the edges of the reflector contaminates the plane wave in the quiet zone. The compact range has been used for many years to measure directive patterns of microwave antennas. Typically, the source antenna is used as an offset feed that illuminates a paraboloidal reflector which converts the impinging spherical wave into a plane wave. Compact ranges can also be used for scattering measurements but require a lower level of stray signals coming from the reflector edges.

To improve the field quality in the quiet zone, one approach has been to use a rolled edge structure with the basic parabolic reflector. W. D. Burnside, M. C. Gilreath, and B. Kent, "A Rolled Edge Modification of Compact Range Reflector," Antenna Measurement Techniques Association, 1984 Conference, Oct. 2–4, 1984. Although this approach improves system performance, it requires excessively large and expensive edge structures. An improvement on this approach has been to use a blended, rolled surface which provides a smooth transition between the parabolic surface and the rolled edge. C. W. I. Pistorius and W. D. Burnside, "A Concave Edged Reflector With Blended Rolled Surface Terminations For Compact Range Applications," Antenna Measurement Techniques Association Annual Meeting and Symposium Sep. 23–25, 1986.

The most cost-effective approach for a given quiet zone size is to use edge serrations since they require only edge cutting and not a different surface shaping. Edge serrations provide a transition of reflected field strength from the high relative levels in the center area of the reflector, corresponding to the test zone area, to zero at the outer periphery of the reflector. However, edge serrations are typically designed from a quasi-Geometric Theory of Diffraction (GTD) point-of-view and not from the field transition point-of-view. Using this new field transition point-of-view can produce better quiet zone performance than previous edge serration shapes.

Also in the prior art is the patent to Holtum, U.S. Pat. No. 3,599,219. Holtum discloses providing an edge configuration to a circular parabolic dish antenna to reduce backlobe radiation. By providing an edge configuration, successive portions of the edge are at differing distances from the feed resulting in variation of the phase of radiation diffracted from successive portions of the edge. Holtum discloses that it is desirable that the conducting extensions depart outwardly from the parabolic shape of the main body of the reflector, regardless of whether it is constructed as an integral extension of the reflector surface or as a separate addition. Furthermore, Holtum teaches the use of a circumscribed polygon structural shape for addition to the circular structure of a dish antenna to achieve a continuously varying radius. He states that to achieve his goal of dispersion of the axial backlobe into numerous sidelobes does not require intricate and precise design of the edge of the diffracting structure.

The Russian patent to Glazman, SU 1137-547-A, discloses the addition of one or two flat diffraction screens to cause a dephasing along the reflector edges producing a suppression in the diffraction of the radiation field by at least 6 dB.

The Japanese patent to Hirukoi discloses the use of a shielding plate around the reflector to limit propagation from the reflector to two planes. The shielding plate is provided in the plane orthogonal to the direction of the incident wave. The shape of the edges of the shielding plate is formed by combining lines parallel to two specific directions in the plane.

SUMMARY OF THE INVENTION

It is thus an object of this invention to improve the test zone performance of compact ranges using reflectors, such as large paraboidal reflectors, by shaping the edge serrations of the range reflectors. The shape of the resulting edges looks like flower petals rather than triangles and provides a smoother average transition value than other edge serrations.

It is another object of this invention to provide a field transition method for determining edge serration shapes which produce a better quiet zone performance.

It is a further object of this invention to provide a method for shaping tile serrations on the edge of a reflector used in reflector antennas to reduce antenna sidelobe levels caused by diffraction for antenna and reflector applications, or to reduce and smooth the amplitude ripples in the quiet zone for compact range applications.

It is a still further object of this invention to provide a smooth transition function for edge serrations which is independent of reflector shape.

The invention consists of shaped, serrated edges which are affixed to or are an integral part of a reflector surface. The outer portion of the reflector with integral or attached serrations defines the transition region. The transition region is denominated as such because it is that portion of the reflector where there is a gradual change in the reflectivity of the reflector due to the presence of edge serrations. The edge serrations are an extension of the reflector surface and are in the same surface geometry. The outlines of the edge serrations are shaped for specific applications based primarily on the feed antenna and/or the subreflector pattern characteristics, the desired sidelobe level, and the pattern shape of the reflector.

A sufficient number of serrations are required to achieve a smooth averaging effect, averaging the 100% reflectivity metallic portions of the edge serrations with 0% reflectivity air portions of the edge serrations, without causing undue periodic disturbances. The serrations are often made of random width to minimize the periodic disturbances if important in a particular application. Other physical forms of field transition can be envisioned such as cutting holes in the reflector surface in tile transition region with typically more holes near the edge than the center or applying absorbing material on the reflector edge with absorbtivity adjusted at each point in the transition region to obtain lower reflectivity levels at the edge versus the central region.

Many serration shapes are possible depending on the application. Not all shapes terminate in a point; the shapes may be truncated. Truncation can be accomplished by simply cutting off the tips of the serrations or by rounding tile tips of the serrations. This might be done for personnel safety considerations to eliminate sharp points at the edge of the reflector. The area of the edge serrations (or other edge devices, geometries, or materials) involved in such truncations is anticipated to be quite small and most often produces neglible reflector performance degradation. Theoretically, however, the desired field transition function is not fully achieved and therefore there is a penalty in reflector performance.

Serrations are a partial reflection mechanism in the average sense. That is, on the average, at a certain distance from the physical edge of a reflector of any shape, any level of reflectivity from 0% to 100% can be achieved by proportioning the ratio of the reflector surface to nonreflector. One way to do this is by the use of serrations. Serrations are made of 100% reflecting material with gaps of nonreflecting material between them. To achieve a 50% reflectivity level, on the average, at a distance of X from the edge of the reflector, the serrations are designed to have a width at that distance equal to the space between the serrations at the same distance. Thus, any function of reflectivity can be achieved versus distance by selecting the ratio of reflector to nonreflector at each point. The serrations are always in the surface of the paraboloid or plane or whatever the original reflector shape is. Other methods of achieving the same reflectivity function versus distance from the edge might be by cutting holes in the reflector or by laying absorbing material on the reflector.

The method of the present invention achieves any desired reflectivity independent of reflector shape. Reflectivity is determined by the ratio of reflector surface to non-reflector surface.

Still other objects, features and attendant advantages of the present invention will become apparent to those skilled in the art from a reading of the following detailed description of the preferred embodiment, taken in conjunction with the accompanying drawings.

DETAILED DESCRIPTION OF THE INVENTION

Figure 1:
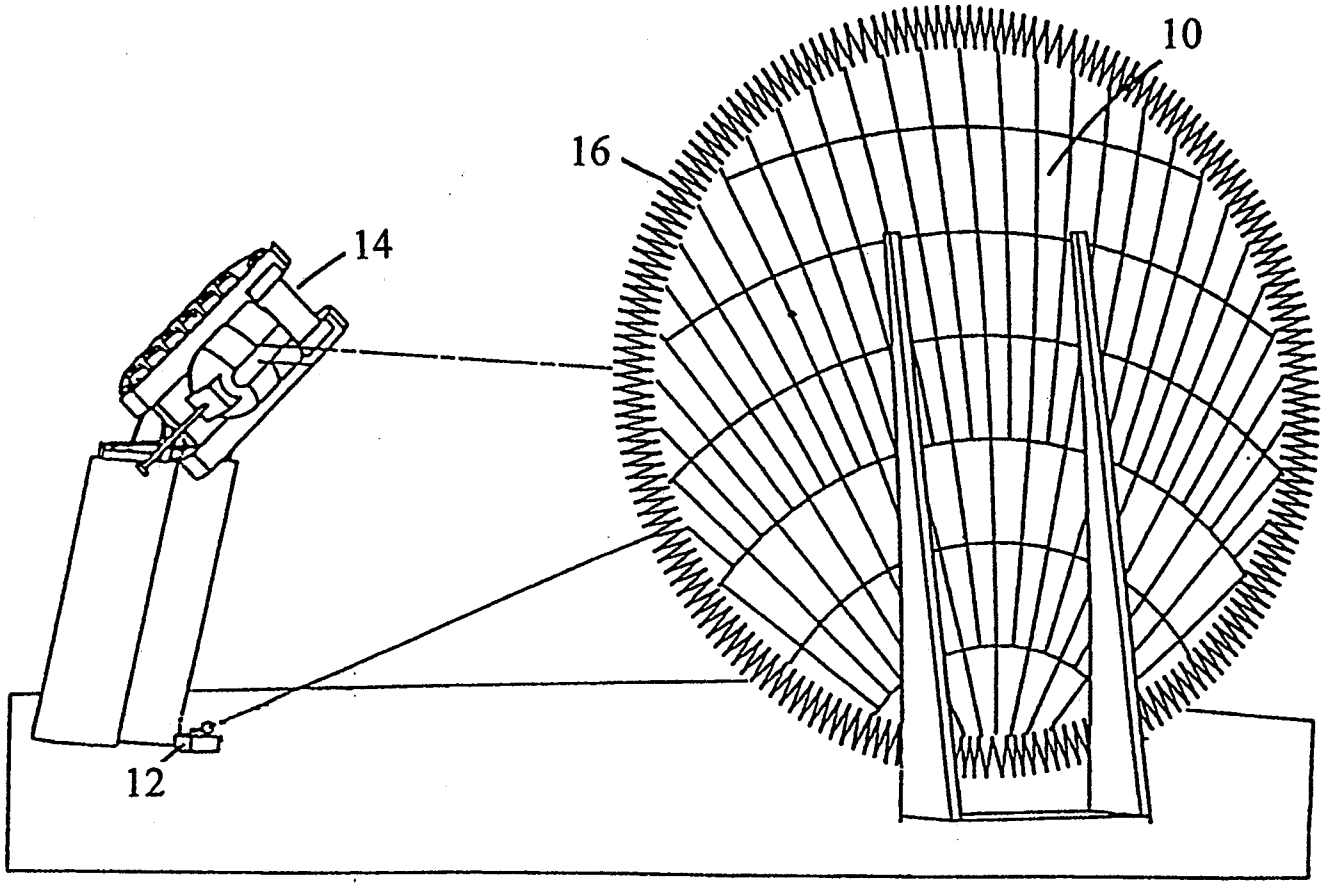
FIG. 1 is a diagrammatic representation of a compact range having serrated edges on a paraboloidal range reflector.

The preferred embodiment of the invention is described as implemented on electrically large paraboloidal and near-paraboloidal reflectors used in compact antenna ranges to produce a quasi-plane wave for antenna measurements. Those skilled in the art will understand that this invention is independent of reflector shape, and may be implemented on non-paraboidal reflectors, as will be explained hereinafter. One limitation of performance of the compact range technique is the presence of unwanted stray radiation due to diffraction at the edge of the compact range reflector. The reflector edge diffraction is significantly reduced through the use of shaped edge serrations. FIG. 1 shows the compact range layout with paraboloidal range reflector 10 being illuminated by source feed 12. The illuminated reflector 10 converts the impinging spherical waves into plane waves which uniformly illuminate test antenna 14. Diffraction from the edge of reflector 10 is reduced by fabricating serrated edges 16 on the reflector outer surface.

The reflector 10 is a 75 ft. diameter (D) offset fed parabola with vertex 2.5 ft. below the 75 ft. diameter circular projection. The focal point (F) of the reflector is 150 ft. from the vertex, forming a F/D ratio of 2.0. The feed antenna 12 has a main beam field strength pattern equal to $\cos^4(\sigma)$. The illumination of the reflector 10 is proportional to the feed pattern and is reduced by space loss which is minimum at the reflector vertex and increases as the distance from tile vertex increases. The reflector illumination is made approximately symmetric by aiming the feed pattern maximum at a point greater than half-way from the vertex side of the reflector 10 to the opposite side of the reflector. The resulting amplitude taper is approximately 0.5 dB at the edges of a 50 ft. diameter central region and approximately 1.0 dB at the edges of the 75 ft. reflector.

Figure 2:
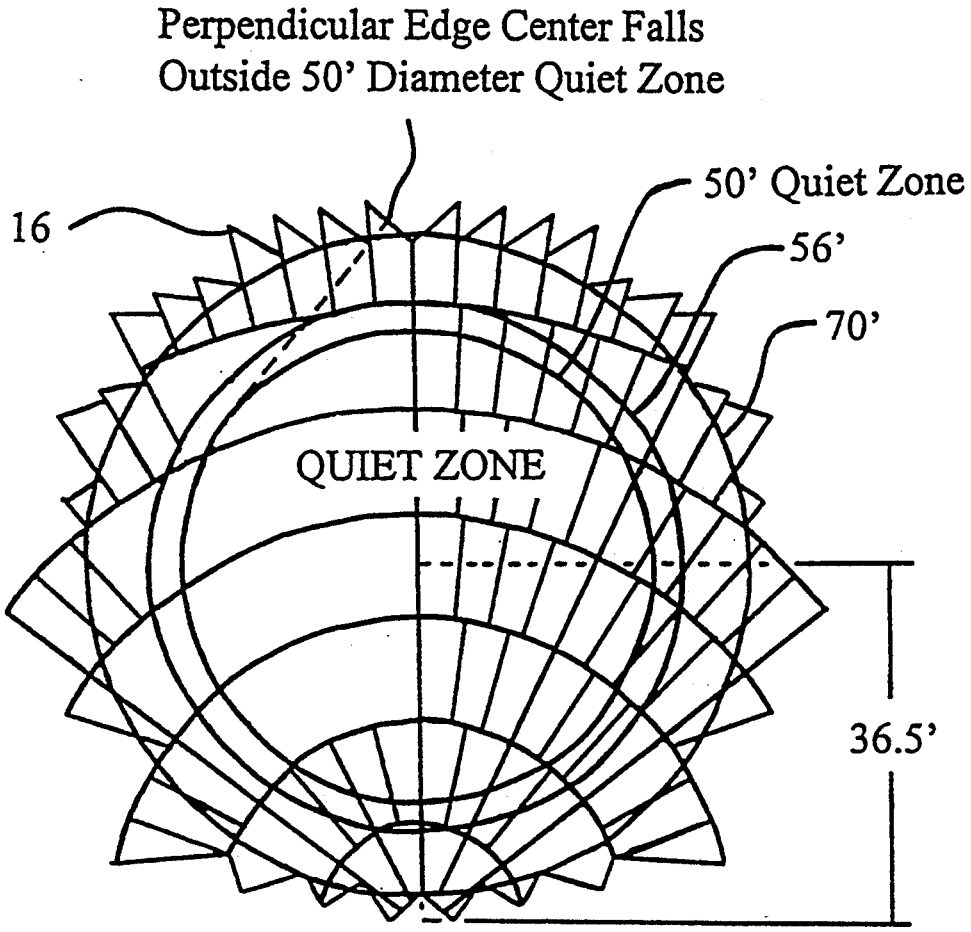
FIG. 2 shows reflector geometry in which the orientation of the serration edges are chosen so that the perpendicular direction from all serration edges does not fall within tile quiet zone.

FIG. 2 shows an edge treatment using low-cost edge serrations 16. These serrations 16 were forced to fit the panelized construction constraints for minimum manufacturing costs. The orientation of these serration edges was chosen such that the perpendicular direction from all serration edges did not fall within tile quiet zone, i.e., the central 50 ft. circle test region.

For purposes of quiet zone field calculation, the focal axis of the reflector is horizontal and at the bottom of the reflector. A vertical aperture plane is constructed perpendicular to the focal axis and very near the reflector surface. A square grid of points is established on the aperture plane and the reflected field from the reflector determined at each of these grid points. A ray is traced from the desired grid point back to the reflector and feed center using Snell's Law to determine the point of reflection on the reflector surface. The field strength at the reflector surface is determined from the pattern of the feed antenna and space loss and the phase is determined by the distance from the feed center to the point on the reflector. The aperture field has the same amplitude as the field on the reflector (collimated field) and has a phase difference proportional to the small distance from the reflector to the aperture plane. The field in the quiet zone vertical plane is calculated from the field on the aperture plane using the following near-field integral:

$$E_{QZ}(X, Y, Z_1) = \tag{1}$$

$$E_{AP}(X', Y', Z_0)(Z_1 - Z_0)\frac{1 + jkR}{R^3}\, e^{-jkR} dX' dY'/2\pi$$

where;

$$R = [(X - X')^2 + (Y - Y')^2 + (Z_1 - Z_0)^2]^{0.5} \tag{2}$$

$E_{AP}(X, Y, Z_0)$ is the aperture field located on the $Z_0$ vertical plane,
$E_{QZ}(X, Y, Z_1)$ is the quiet zone field located on the -continued $Z_1$ vertical plane, and
$Z_1 > Z_0$.

Figure 3A:
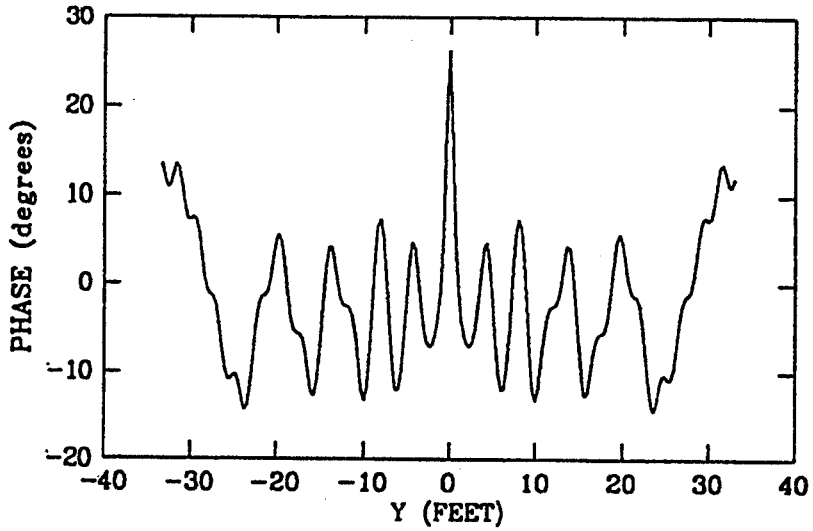
FIGS. 3*a* and 3*b* show the amplitude and phase of a vertical cut of the quiet zone field for the case of no edge treatment.
Figure 3B:
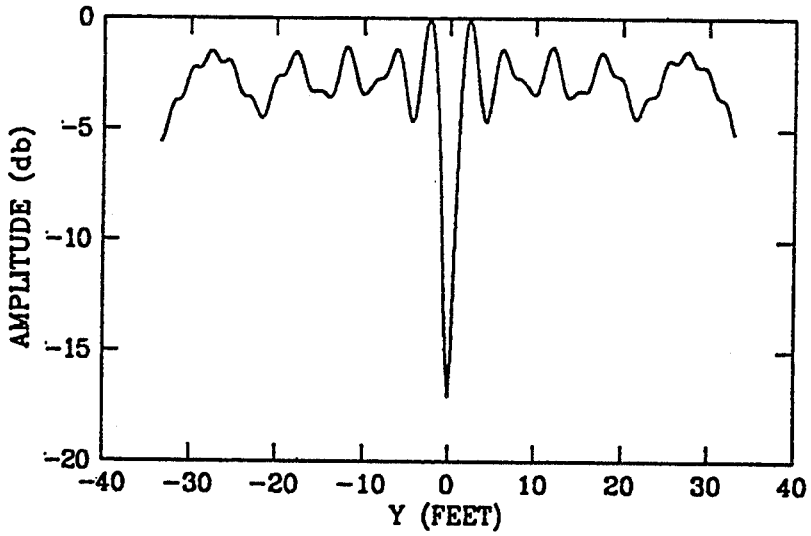

The aperture field at the outer edge of the 75 ft. diameter reflector 10 is only 1.0 dB less than in the center of the reflector and then falls to zero strength just beyond the edge. Thus, a large discontinuity of the field exists in the aperture plane edge resulting in a large amount of diffraction. The diffraction, in Fourier Transform terminology, is associated with tile high sidelobe level of the plane wave spectrum of this quasi-rectangular function with the associated step edge discontinuity. FIGS. 3*a* and 3*b* show the amplitude and phase of a vertical cut of a quiet zone field located 150 ft. from the reflector vertex for the case of no edge treatment. The quiet zone field is seen to have large variations of amplitude and a characteristic center "caustic" point.

The sidelobe levels due to diffraction of the aperture field can be greatly reduced by providing a non-step transition from the high reflected field levels of the reflector surface to the zero level fields just outside the reflector. The edge treatment of the reflector provides this transition. The best transition function is tile solution of an optimization problem which minimizes the amount of diffraction given a fixed size edge treatment region.

The particular function experimented with is a raised cosine type of transition function of the form for circular reflectors:

$$T(r) = (1/2[1 + \cos(\pi(r - r_{min})/(r_{max} - r_{min}))])^A, \tag{3}$$
for $r_{min} \leqq r \leqq r_{max}$ and
$T(r) = 1, r \leqq r_{min}$ where:

r is the radial distance from the center of the reflector to a point between $r_{min}$ and $r_{max}$,
$r_{min}$ is the beginning of the transition region,
$r_{max}$ is the end of the transition region, and
A is a non-zero parameter.

This type of transition function equals 1 at $r_{min}$, 0 at $r_{max}$, has a constant phase and is used to multiply the aperture field that would exist without edge treatment. The minimum serration length ($r_{max}-r_{min}$) is approximately 10–15 wavelengths.

Figure 15:
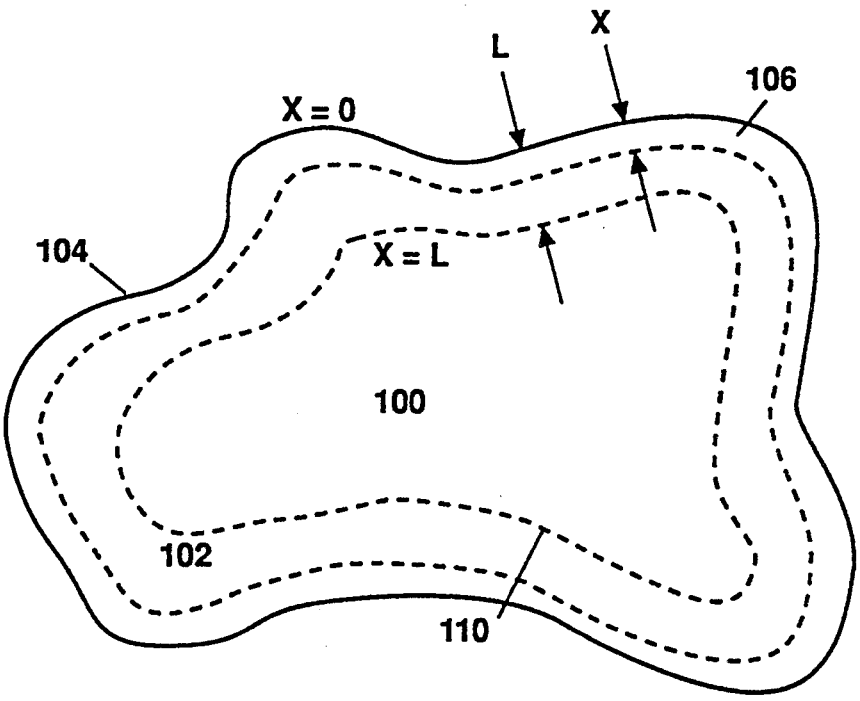
FIG. 15 illustrates reflector and transition geometry.
Figure 16:
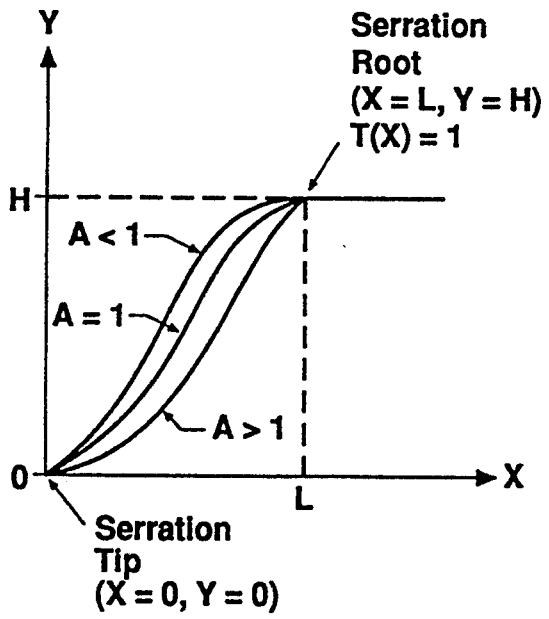
FIG. 16 graphs a specific transition function for various values of A.

Turning now to FIGS. 15 and 16, it carl be seen that the formula previously discussed for transition function is actually a special case of a more general formula. FIG. 15 shows the transition region 102 for a reflector surface 100. The distance from the reflector edge 104 of the reflector is given by X 106 and the width of the the transition region is shown as L. The desired transition function has a value of zero at the edge 104 of the reflector (X=O) and a value of 1 at the inner edge 110 of the transition zone (X=L). The shape of the transition function depends on the desired characteristic of the reflector scattering, such as low sidelobe levels, low scattering in the quiet zone of a compact range, low sidelobe level in a specified region of the reflector scattering, etc. A near optimal transition function found for the case of minimizing the scattering into the quite zone of a compact range was found to be given by:

$$T(X) = (1/2[1 + \mathrm{Cos}(\pi X/L)])^A \tag{4}$$
for $O \leqq X \leqq L$
and $T(X) = 1, X > L$ where X for each point on the edge of the reflector, is the distance inward along the reflector surface in a direction perpendicular to a line tangent to the reflector edge at that point, X being determinable from the distance L which is set at design and equals at least ten wavelengths of a selected lowest frequency at which the reflector is to operate L is the width of the transition region and length of serration A is a non zero parameter The transition function T(X), where X is the distance from the edge of the reflector as shown in FIG. 15, is derived for each application. The derivation of the transition function is usually carried by an iterative process, ideally using a computer, where the raised cosine function given in Equation (4) is often used as a starting point fox the optimization. The optimization is tile enhancement or the reduction of one or more of the important scattering characteristics of the reflector such as average sidelobe level, peak sidelobe level, scattering into a certain angular region, scattering into the quiet zone of a compact range, front to back far field pattern ratio of the reflector scattering, etc. The scattering from the reflector is often calculated using computer techniques such as a) the method of moments, b) geometrical theory of diffraction, c) physical, optics integration, etc. The scattering analysis is conducted using a trial transition function (implemented as some edge treatment, such as serrated edges), and then repeated after some small change to tile transition function, has been made, such as changing the parameter A in Equation (4). This iterative approach then leads to a best transition function for the particular application. The only constraints on the transition function are that it have a value of zero at X=O and a value of one at X=L and take on only values between zero and one between X=O and X=L.

FIG. 16 illustrates the transition function of Equation (4) for several different values of A. A value of A=0.8 was found to be best for a specific compact range design in which the reflector was a 75 foot diameter, circular portion of an offset fed paraboloid with focal length of 150 feet and 64 edge serrations. The low frequency limit for this design is 1.0 GHZ. Associated with this lower frequency limit is a wavelength given by the speed of light divided by the frequency. The speed of light in a vacuum (air is nearly the same) is 300,000,000 meters per second. If the frequency is 1.0 GHz then the wavelength is 0.3 meters. This lower frequency limit is important in the specification and design of serration length and thus the transition zone width. The optimum serration length (transitions zone width) is related to the wavelength of this lower frequency limit. Typically, an optimum serration length is between 10 and 15 lower-frequency-wavelengths. That is, those lengths provide the greatest improvement in antenna performance for the least serration length.

Approaches used to implement a field taper include serrated edges, rolled edges, absorbing edges and feed subreflectors. Because of their low-cost, serrated edges are favored as they are cut out of the existing reflector surface shape and are effective over a wide frequency range. The particular transition function chosen is a constant phase function which requires the paraboloidal shape surface. Rolled edges, as an example, change both the amplitude and phase of the reflected aperture field. Paraboloidal serrations provide a constant phase amplitude taper by averaging the 100 percent reflection of the illumination for the metal portions of the serrations and zero reflection for the absent portions of the serrations. Thus, a wide range of amplitude tapering functions can be achieved by adjusting the metal-space ratio of the serrations versus radius of the serrations. The raised cosine transition function yields flower-petal shaped serrations.

Figure 4A:
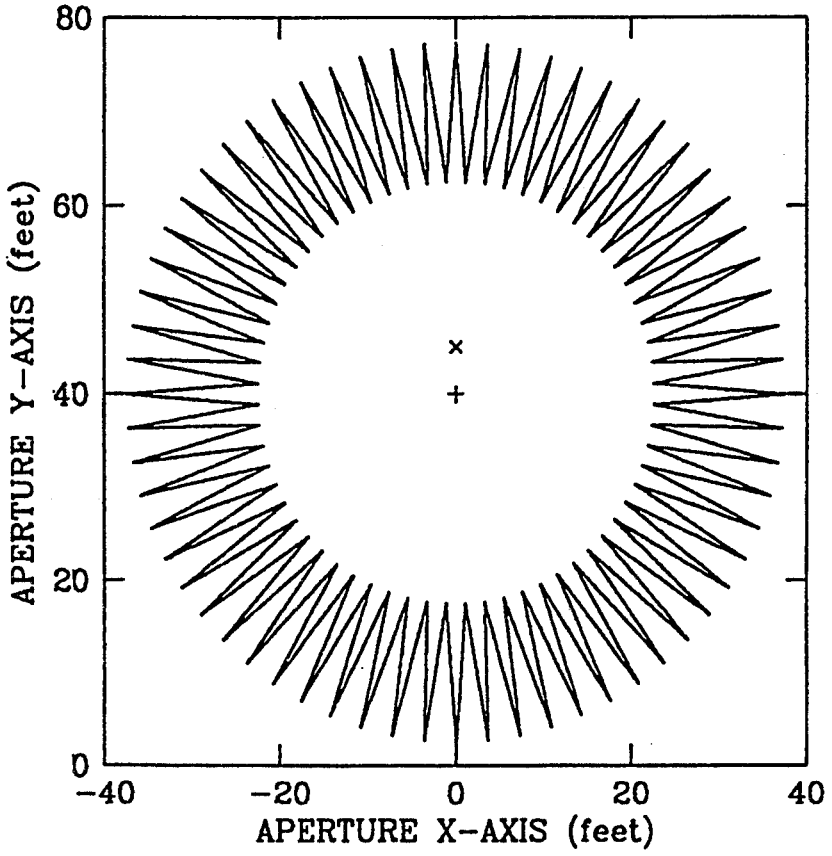
FIGS. 4*a*–4*c* show the amplitude and phase and a frontal view of a vertical cut of the quiet zone field for 64 triangularly shaped serrations, each 15 feet long.
Figure 4B:
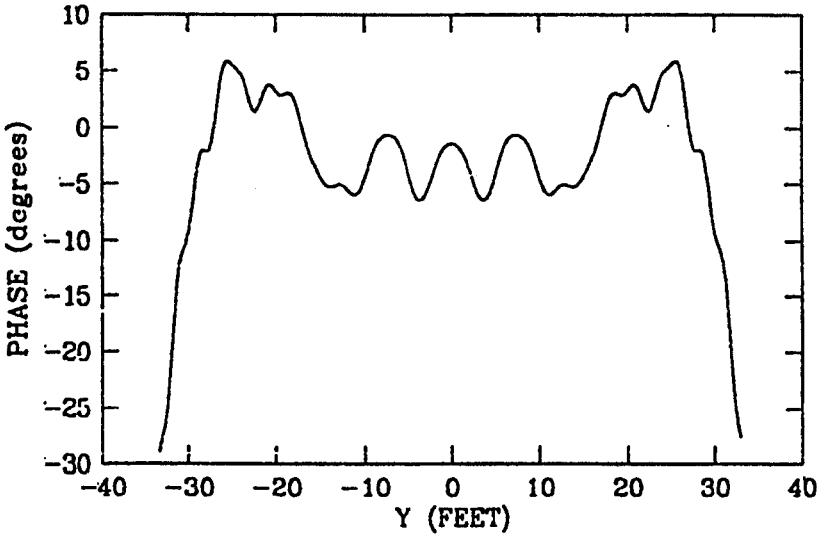
Figure 4C:
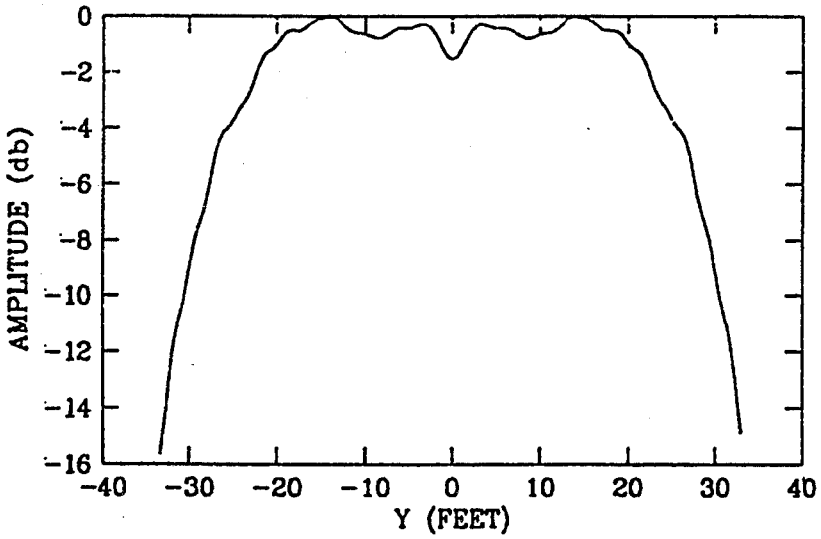
Figure 5A:
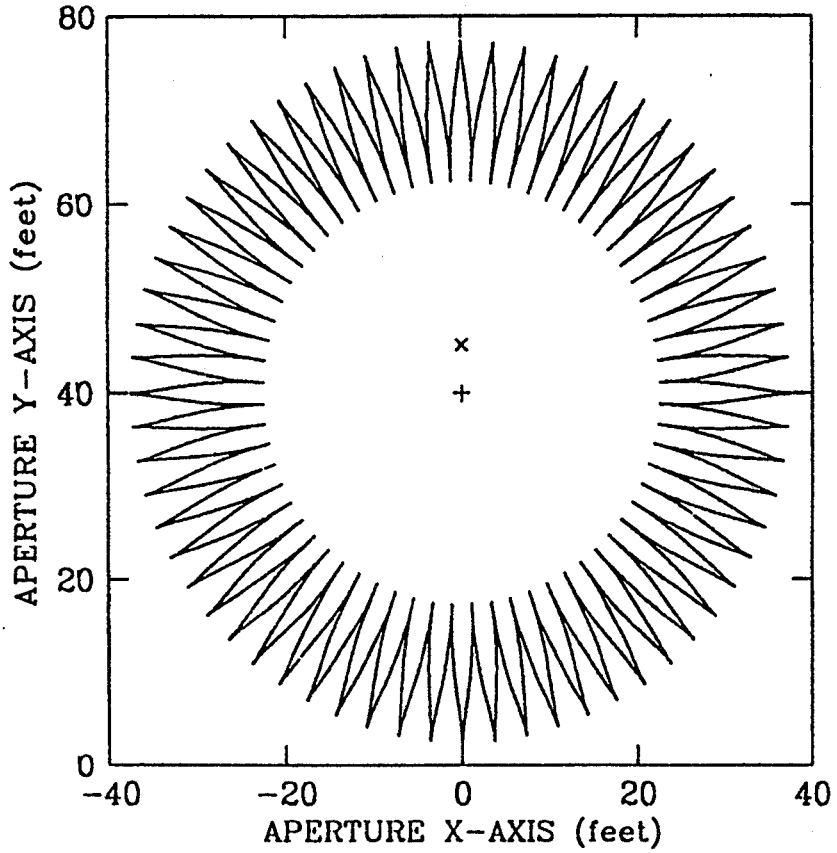
FIGS. 5*a*–5*c* show the quiet performance and reflector shape for 64 shaped serrations each 15 feet long, and having the raised cosine transition with parameter A=0.5.
Figure 5B:
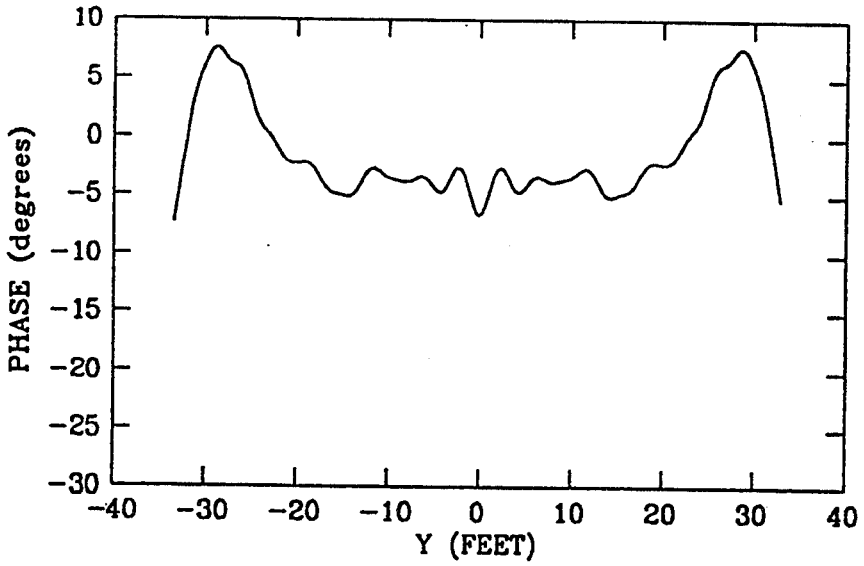
Figure 5C:
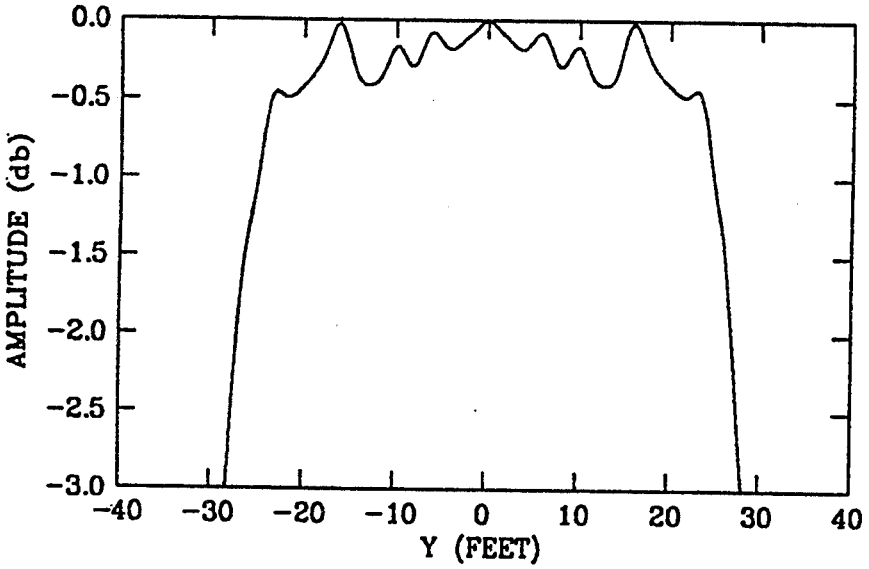
Figure 6A:
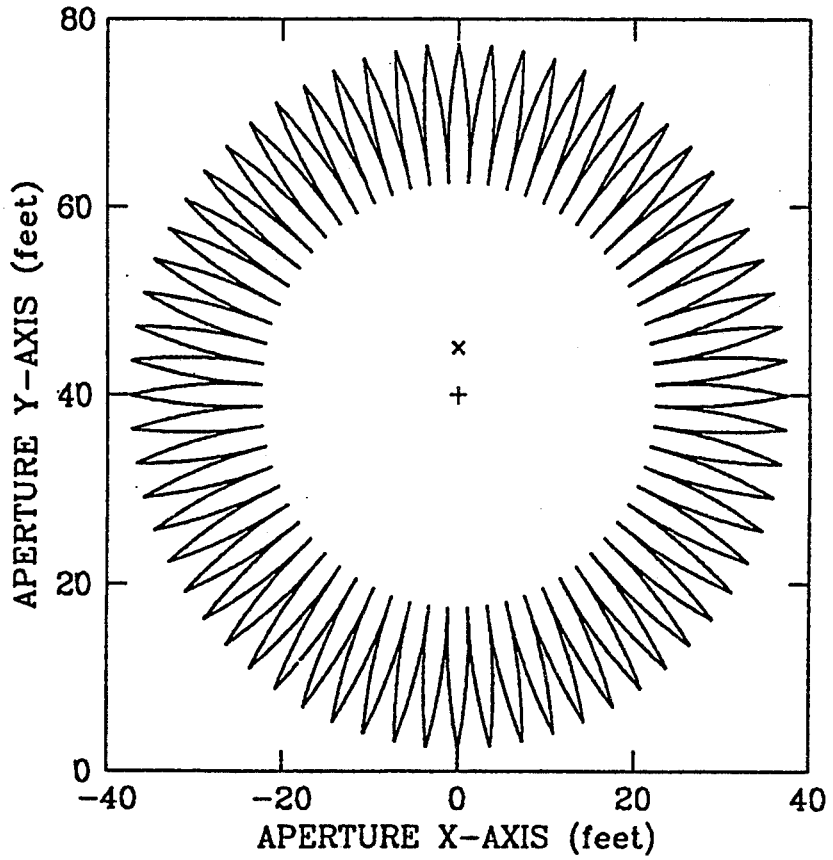
FIGS. 6*a*–6*c* show the quiet zone performance and reflector shape for 64 shaped serrations each 15 feet long, and having the raised cosine transition with parameter A=0.7.
Figure 6B:
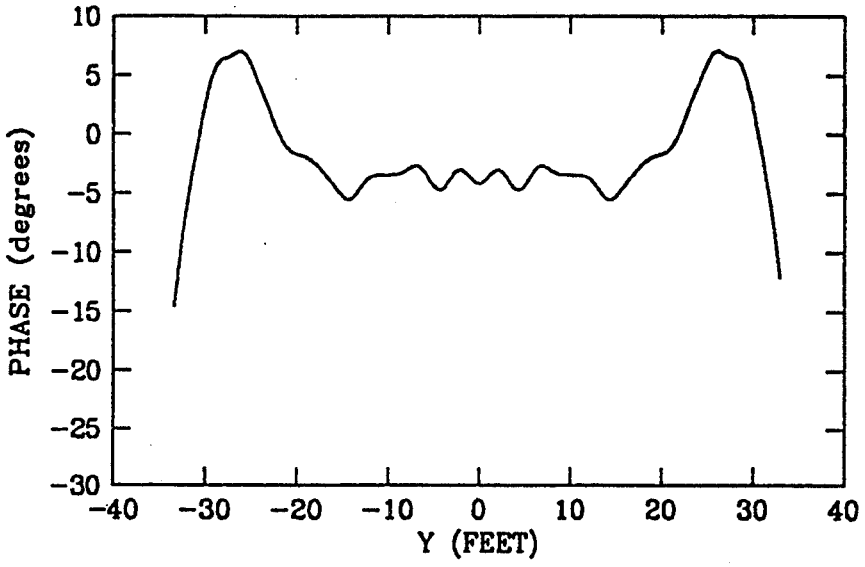
Figure 6C:
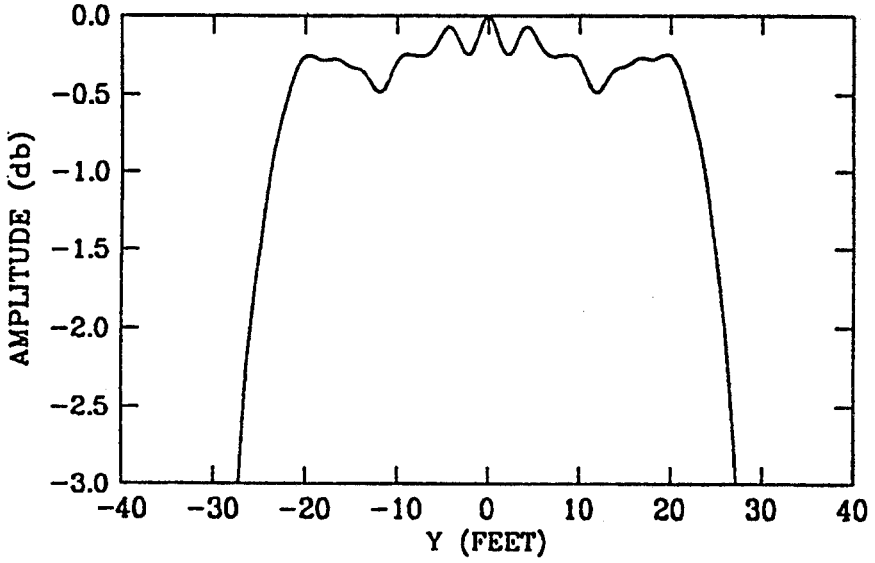
Figure 7A:
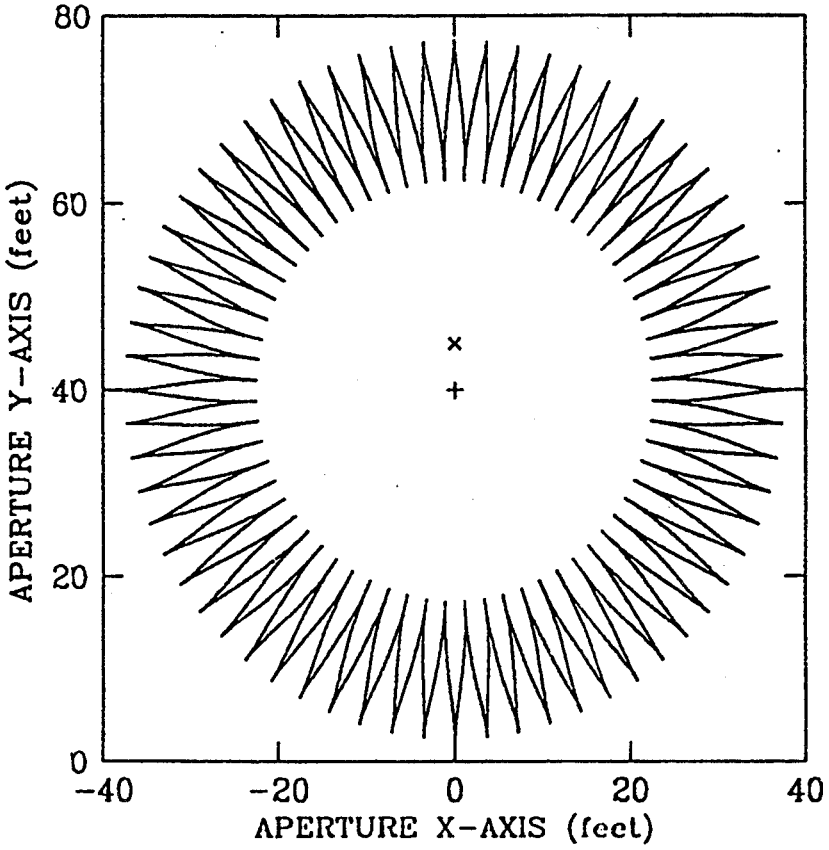
FIGS. 7*a*–7*c* show the quiet zone performance and reflector shape for 64 shaped serrations each 15 feet long, and having the raised cosine transition with parameter A=0.8.
Figure 7B:
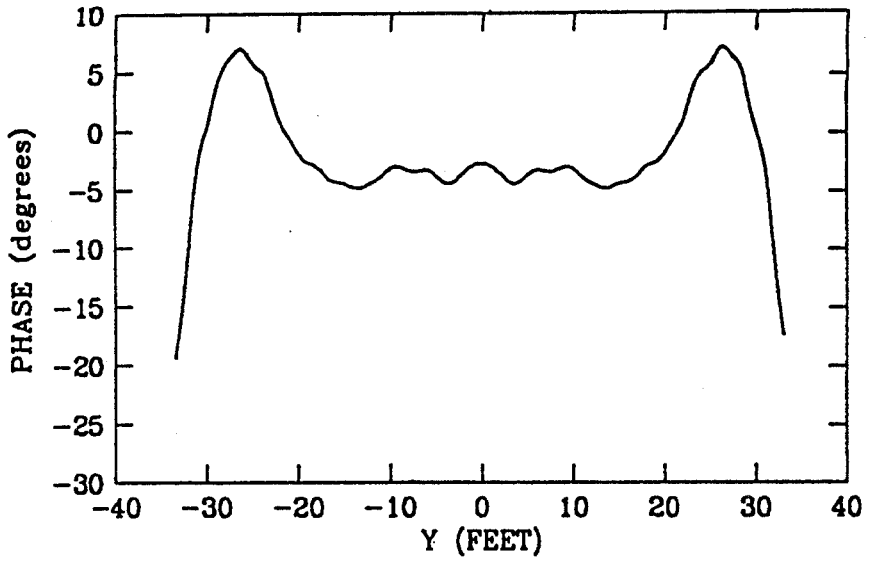
Figure 7C:
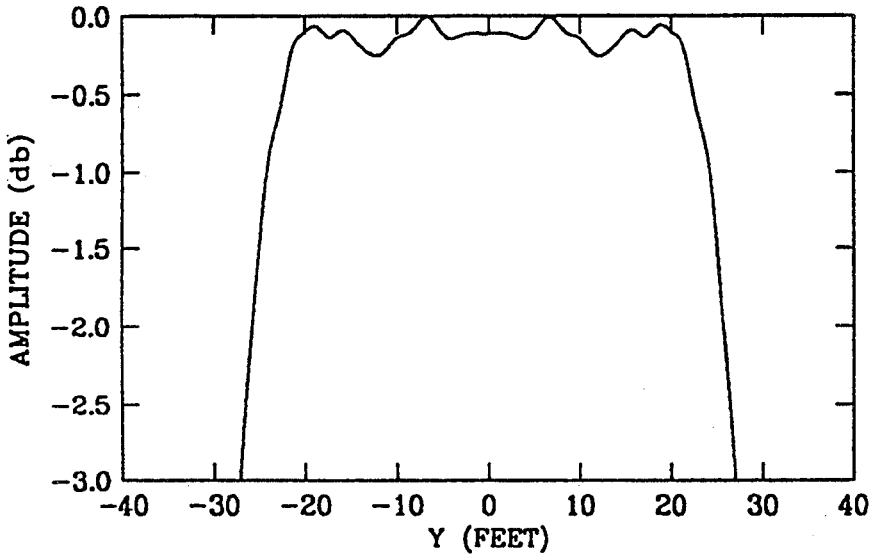
Figure 8A:
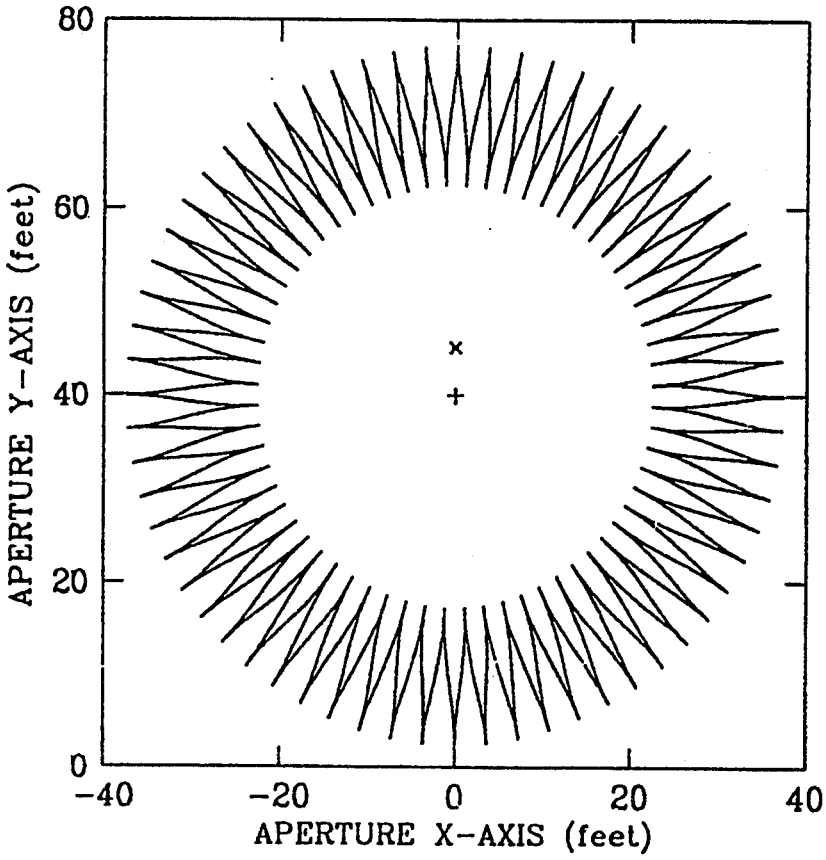
FIGS. 8*a*–8*c* show the quiet zone performance and reflector shape for 64 shaped serrations each 15 feet long, and having the raised cosine transition with parameter A=1.0.
Figure 8B:
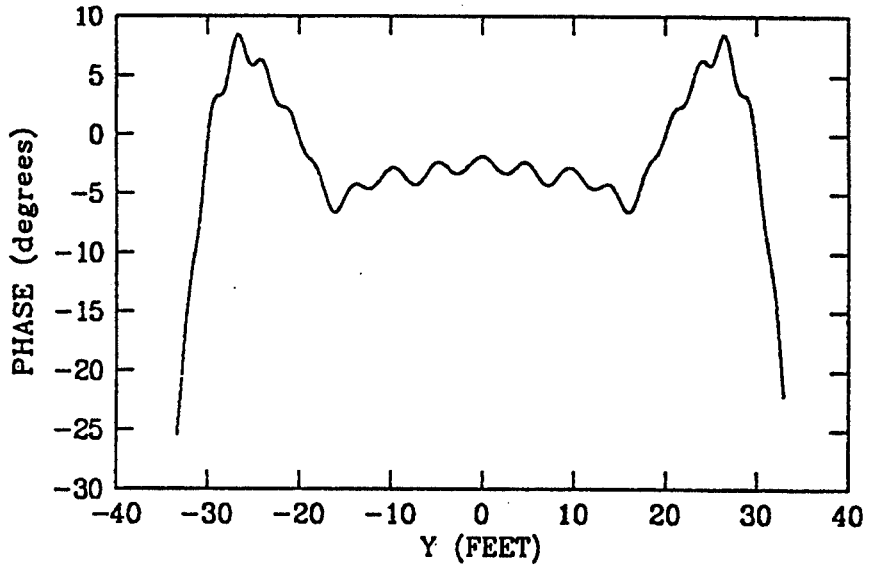
Figure 8C:
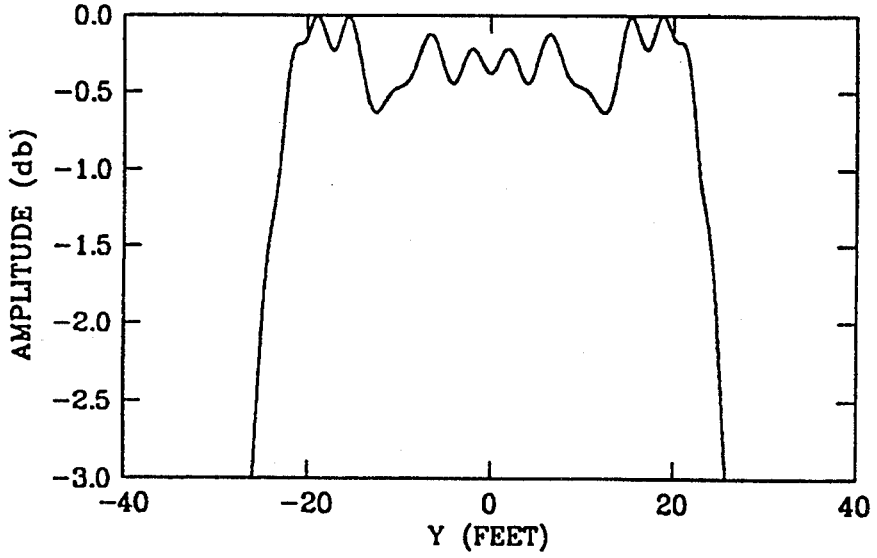
Figure 9A:
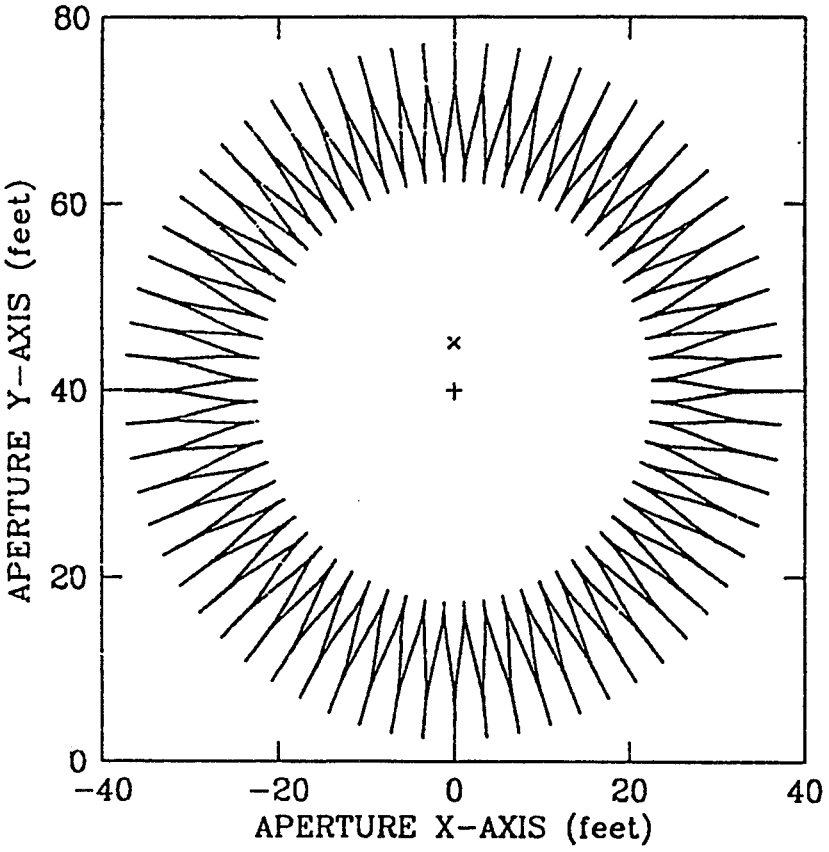
FIGS. 9*a*–9*c* show the quiet zone performance and reflector shape for 64 shaped serrations each 15 feet long, and having the raised cosine transition with parameter A=2.0.
Figure 9B:
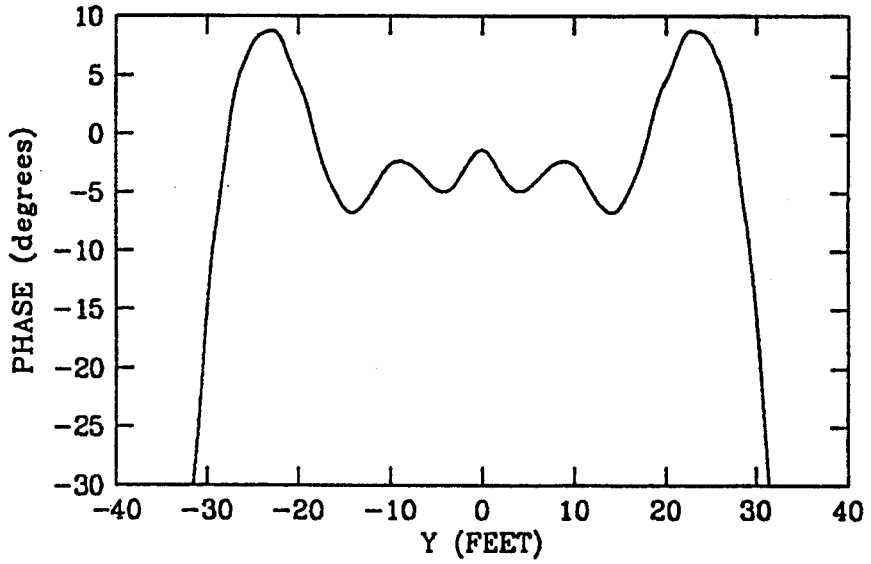
Figure 9C:
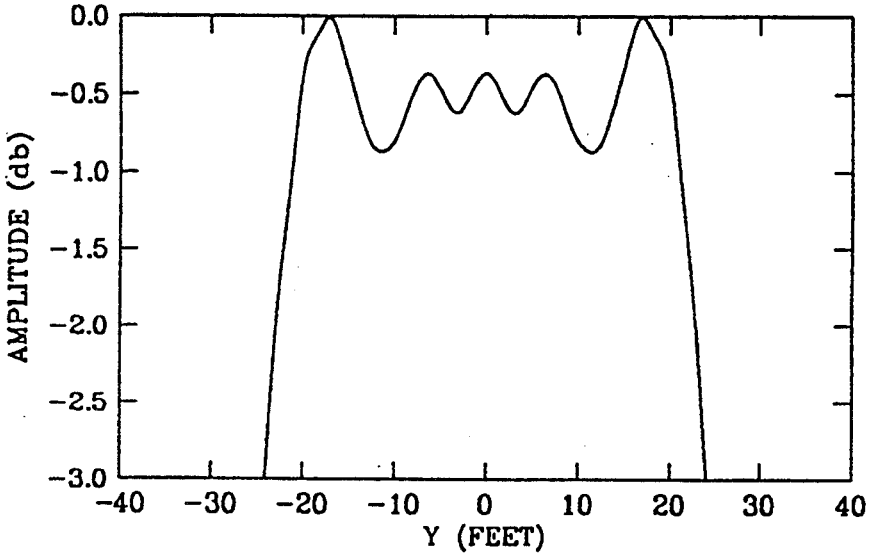

FIGS. 4a–4c show a vertical cut of the quiet zone field for 64 triangularly-shaped serrations 16 each 15 ft in length, and also shows the frontal view of this reflector. FIGS. 5a–5c, 6a–6c, 7a–7c, 8a–8c and 9a–9c show the quiet zone field performance and reflector shape for the raised cosine transition function with the parameter A having values equal to 0.5, 0.7, 0.8, 1.0 and 2.0, respectively. For all these cases, the reflector 10 has 64 serrations 16 each 15 ft. in length and the frequency is 1 GHz. The best case appears to be the A=0.8 case with peak-to-peak amplitude ripple of approximately 0.25 dB over a 44 ft diameter quiet zone.

Figure 10A:
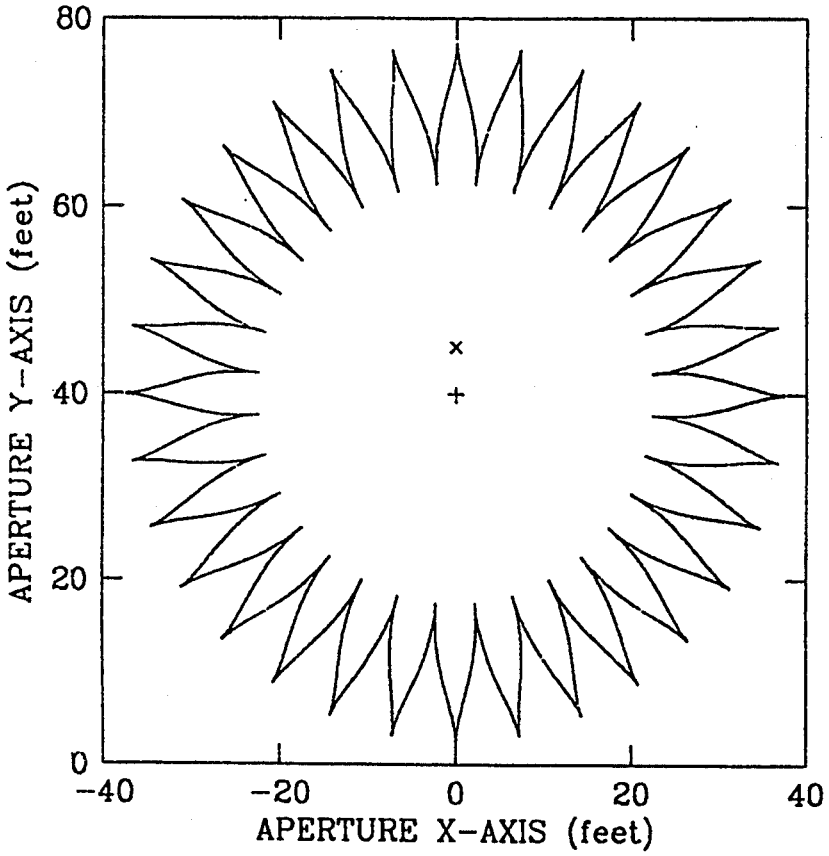
FIGS. 10*a*–10*c* show the quiet zone performance and reflector shape for 32 shaped serrations each 15 feet long, and having the raised cosine transition with parameter A=0.8.
Figure 10B:
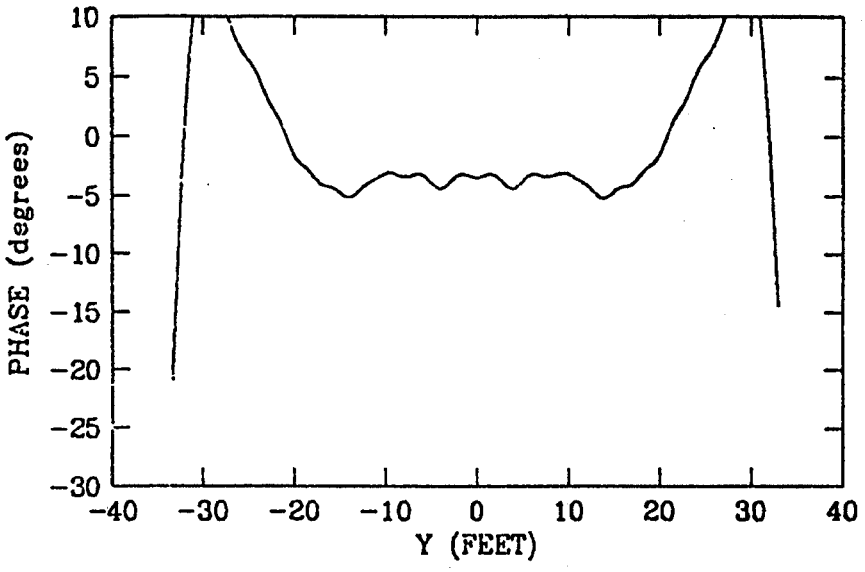
Figure 10C:
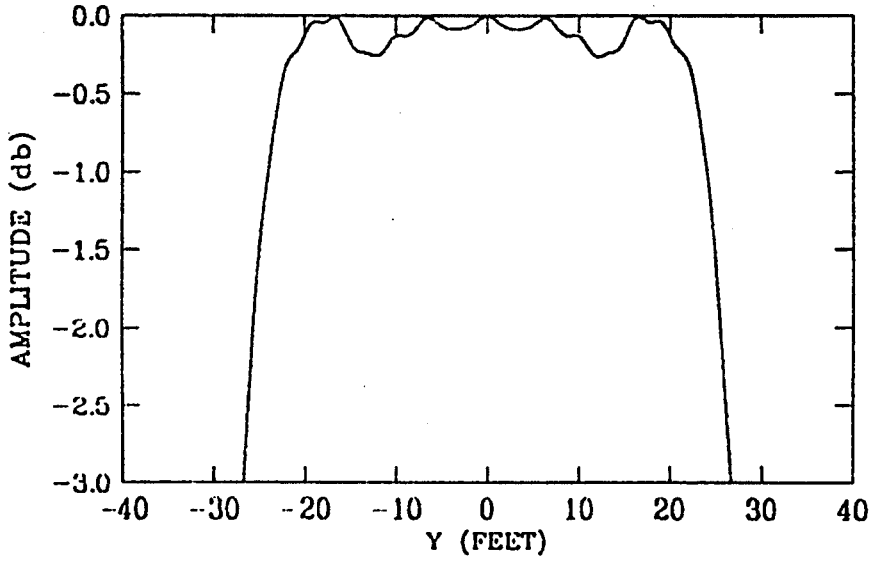
Figure 11A:
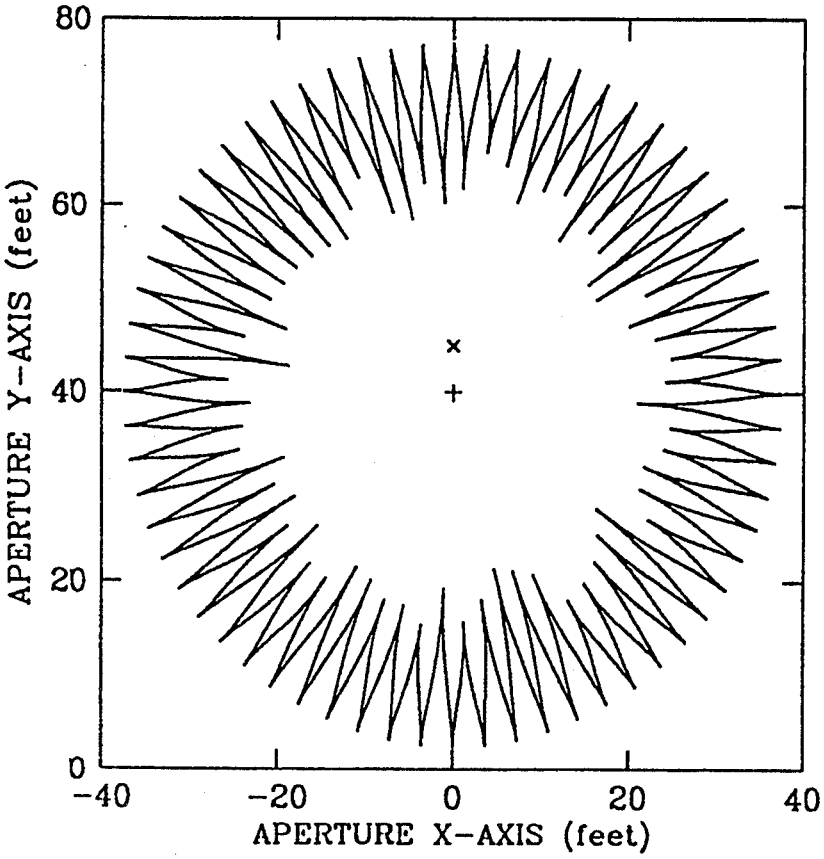
FIGS. 11*a*–11*c* show the quiet zone performance and reflector shape for 64 shaped serrations, each 15 feet long, and having the raised cosine transition with parameter A=0.8 and with uniformly distributed inner serration radii.
Figure 11B:
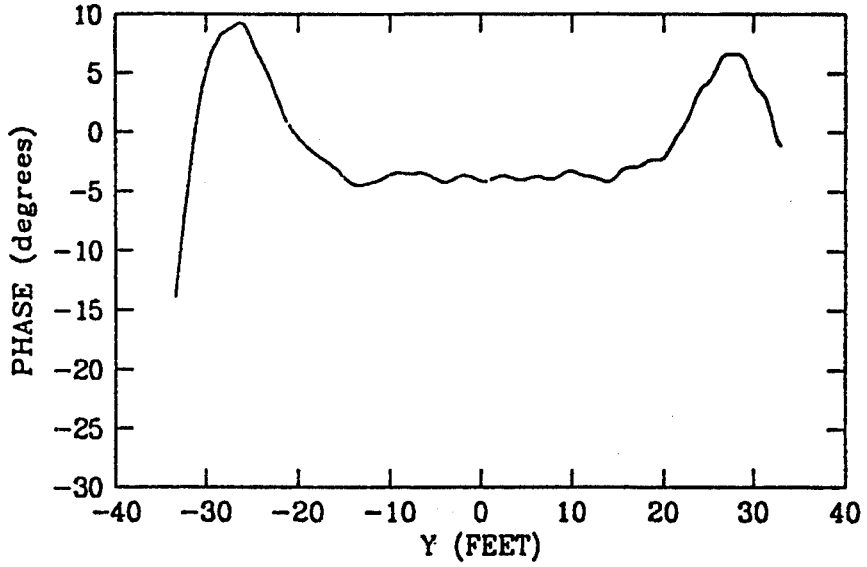
Figure 11C:
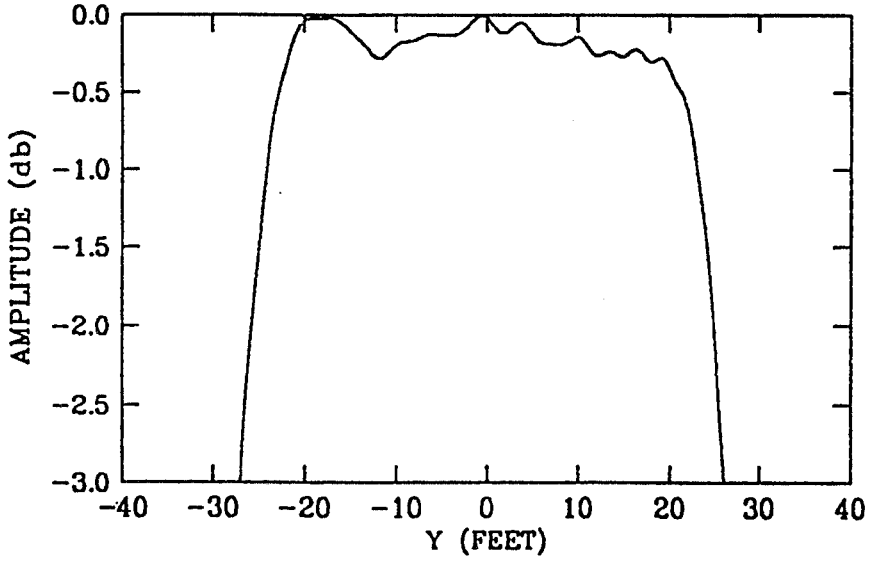
Figure 12A:
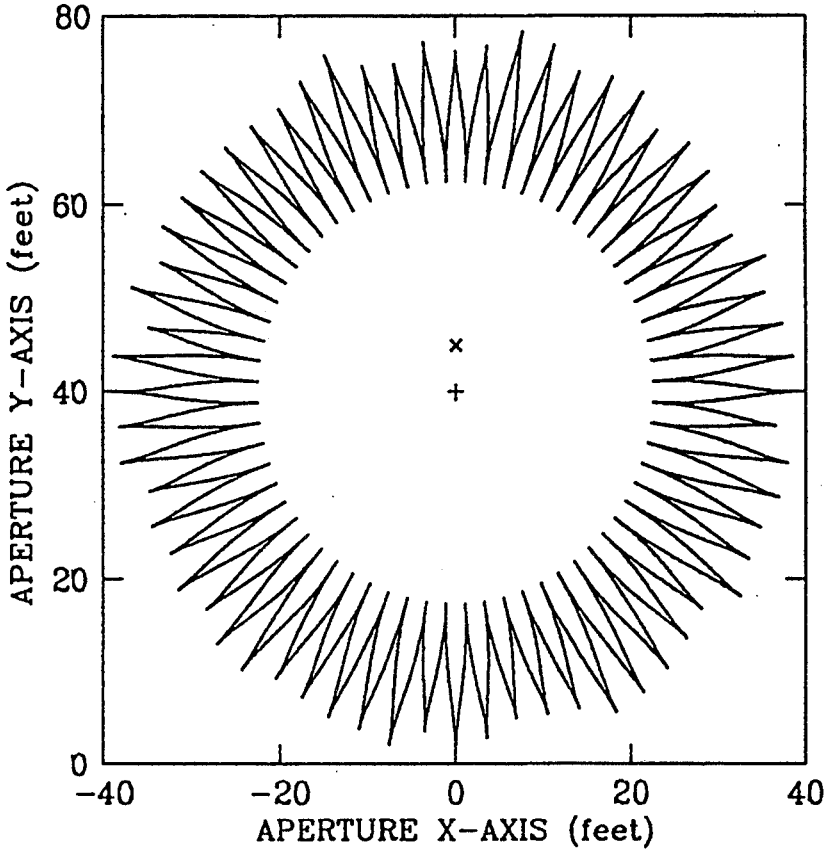
FIGS. 12*a*–12*c* show the quiet zone performance and reflector shape for 64 shaped serrations, each 15 feet long, and having the raised cosine transition with parameter A=0.8 and with uniformly distributed outer serration radii.
Figure 12B:
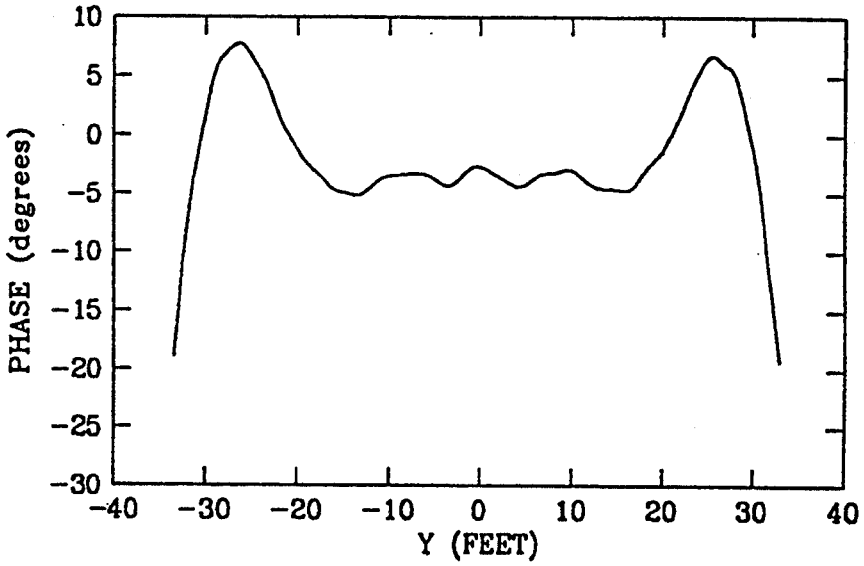
Figure 12C:
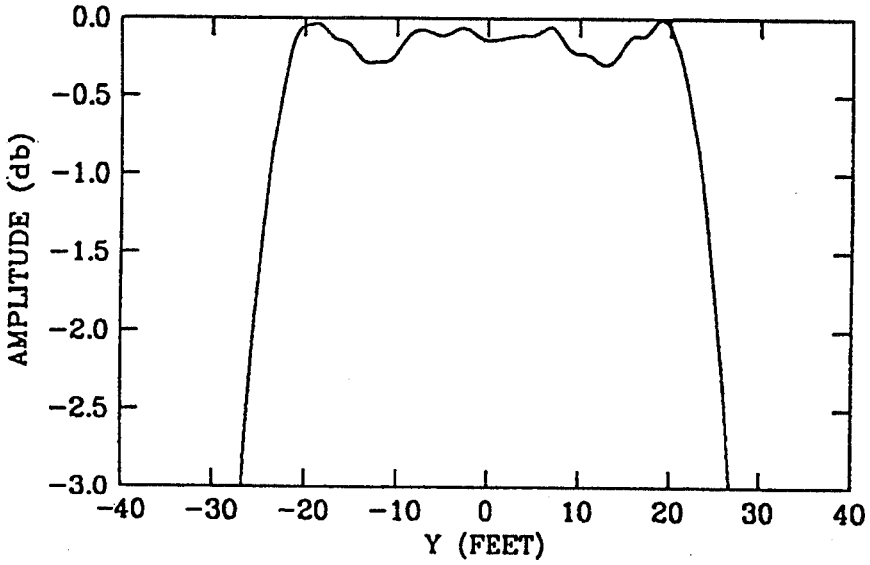
Figure 13A:
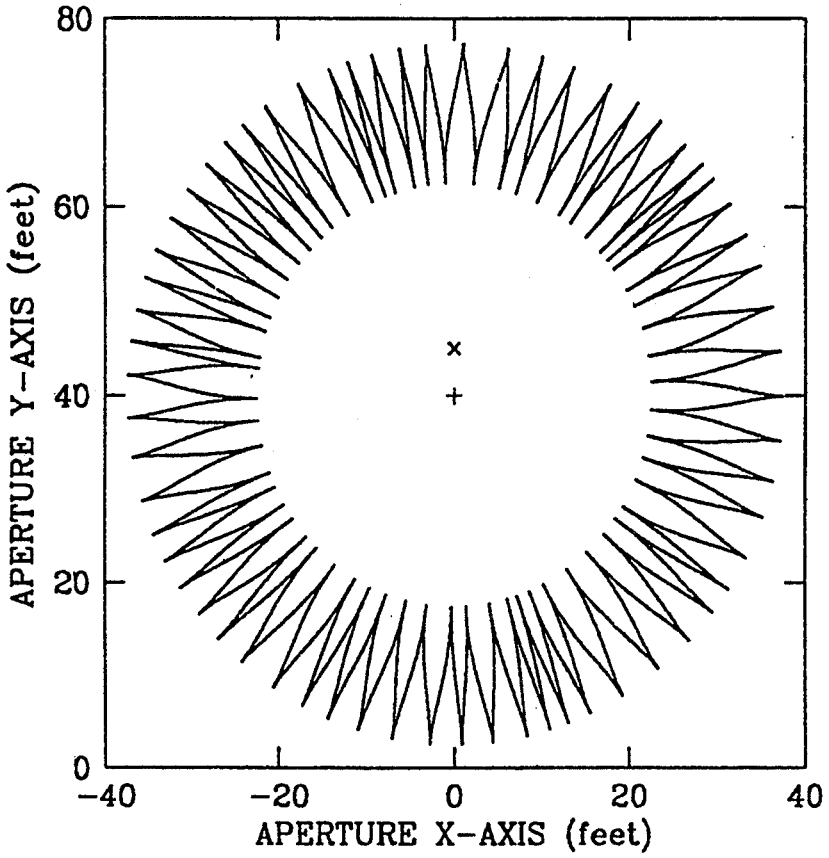
FIGS. 13*a*–13*c* show the quiet zone performance and reflector shape for 64 shaped serrations, each 15 feet long, and having the raised cosine transition with A=0.8 and with uniformly distributed random serration widths.
Figure 13B:
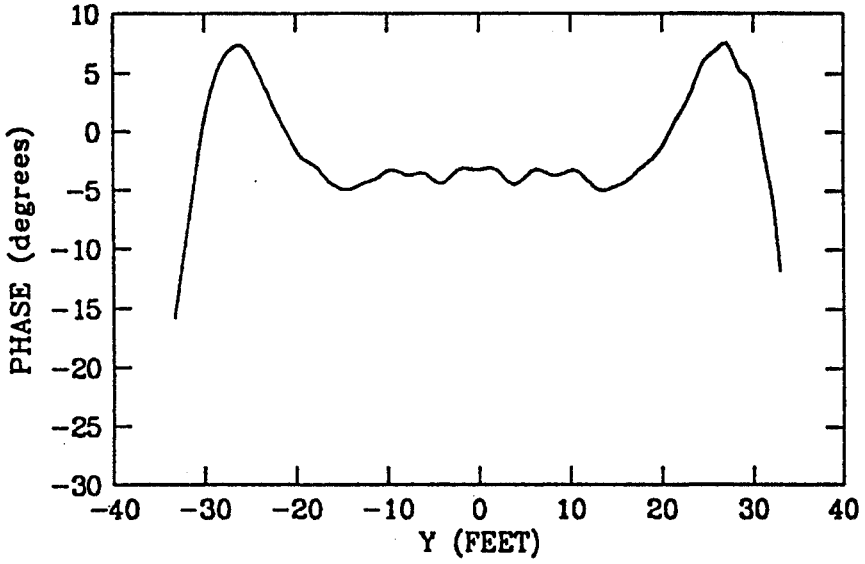
Figure 13C:
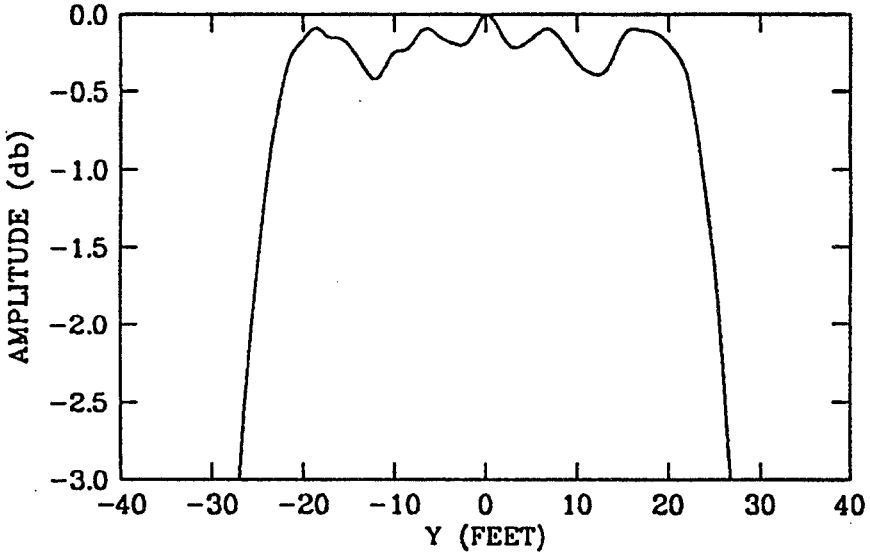

Extensive computer experimentation conducted on variations of the edge serrations 16 showed that the quiet zone field appears to be insensitive to a random variation in the length ($r_{max}$) of each petal. Random variation of the inner radius ($r_{min}$) of each serration showed a similar insensitivity of the quiet zone field. Random variation of the width of each petal showed insensitivity as well, with uniform width being best. Variation of the number of serrations 16 was conducted over a range from 32 to 128 serrations. FIGS. 10a–10c show the quiet zone performance and reflector shape for 32 serrations, a raised cosine (A=0.8) with 15 ft. serrations. The quiet zone performance is again relatively insensitive to this change, in this case degrading peak-to-peak ripple only slightly from the 0.25 dB level for the 64 serrations case.

FIGS. 11a–11c, 12a–12c, and 13a–13c show the quiet zone fields and serration shapes for random variations of the inner serration radii, outer serration radii and serration width respectively. In each case there are 64 serrations with an average length of 15 feet and with the parameter A=0.8. These figures show the relative insensitivity of these serration shapes.

Figure 14A:
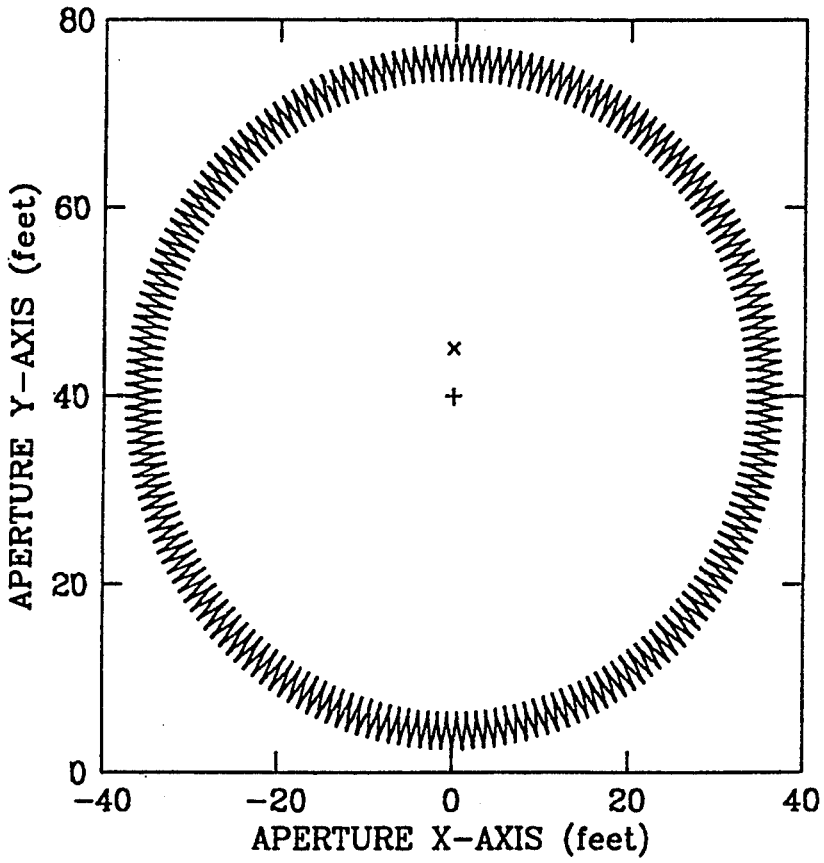
FIGS. 14*a*–14*c* show the quiet zone performance and reflector shape for 192 shaped serrations, each 4 feet long, with parameter A=0.8 at 6 GHz.
Figure 14B:
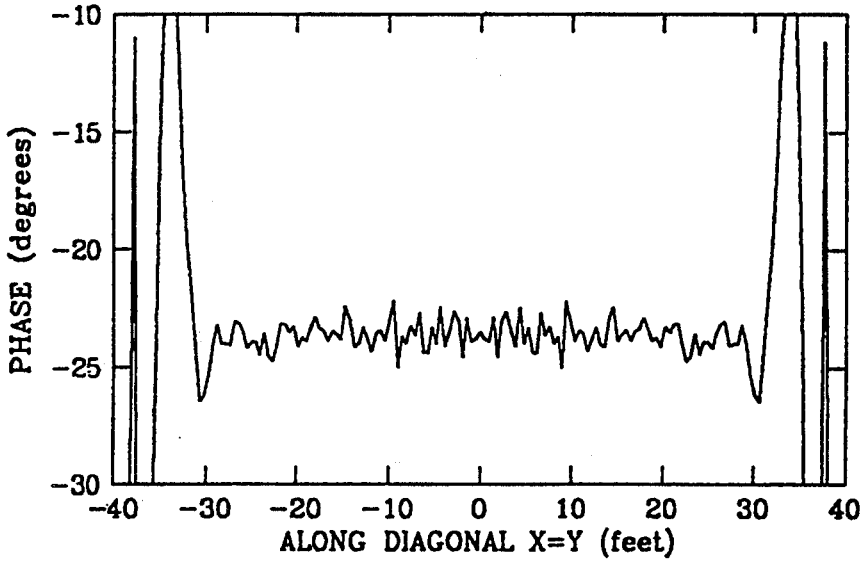
Figure 14C:
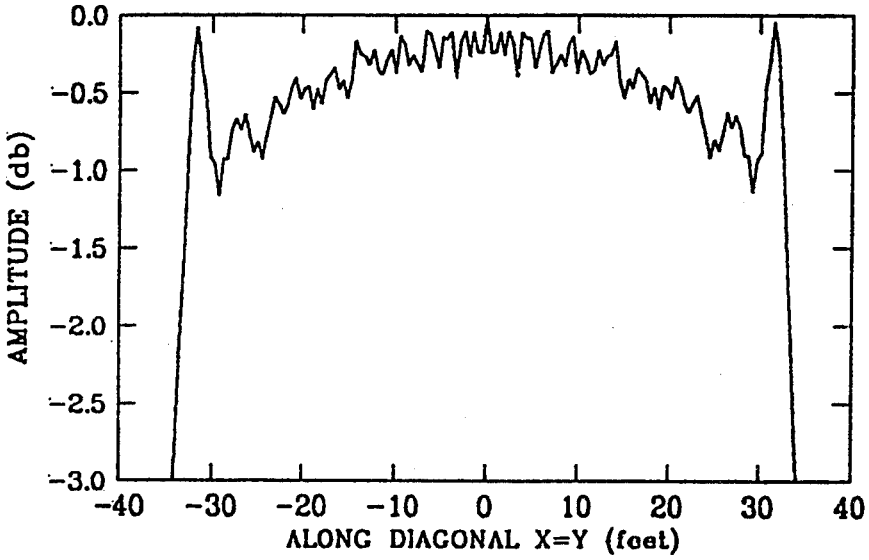

FIG. 14a–14c shows the computed diagonal cut of the quiet zone fields and reflector configuration for a design frequency of 6 GHz, operating at 6 GHz. Here there are 192 equal width serrations, each with a 4 foot length and A=0.8. The quiet zone figures show the same ripple value of 0.25 dB, but the feed plus space loss taper of approximately 0.8 dB is clearly visible over the 60 ft. quiet zone.

The equation for the A=0.8 edge serration shape projected onto the reflector aperture plane is given in terms of radius, r, as a function of angle, $\phi$. The variable $r(\phi)$ represents the radial distance, at an angle $\phi$, from the center of the reflector to the outer edge of the reflector. The variable $\phi$ represents the angle measured clockwise about the center of the reflector from the radius corresponding to the maximum radial distance for a particular serration, $r_{max}$, to a radial corresponding to a point along the outer edge of the reflector. The equation for one half of a single serration extending from the tip located at $\delta=0°$ and extending to a valley at $\phi=360°/2N$ where N is the number of equal width serrations is given by:

$$r(\phi) = r_{min} + (r_{max} - r_{min})\cos^{-1}[2(\phi/360°/2N)^{1/A} - 1]/\pi, \quad (5)$$

-continued for $0 \leqq \phi \leqq 360°/2N$, where $A = 0.8$.

Figure 17:
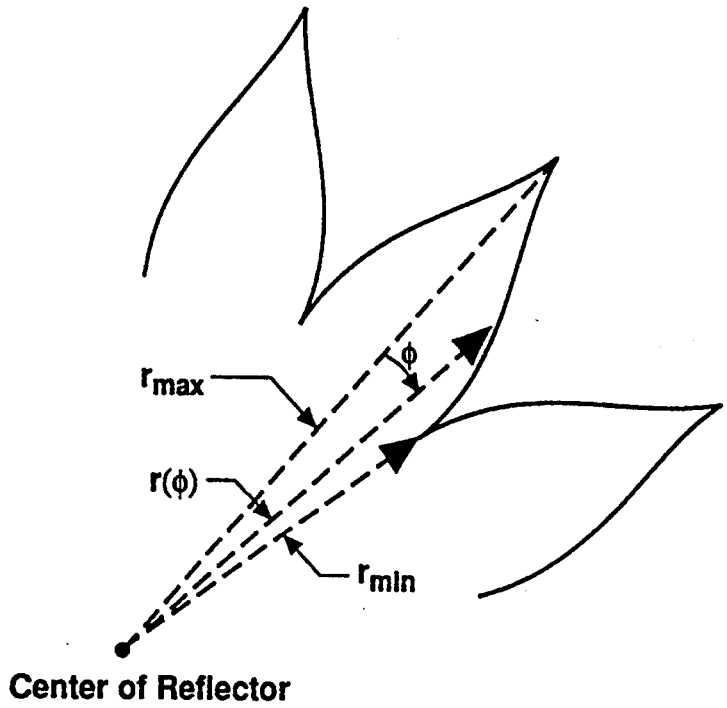
FIG. 17 is an enlargement of the serrated edges on the paraboloidal range reflector of FIG. 1.
Figure 18:
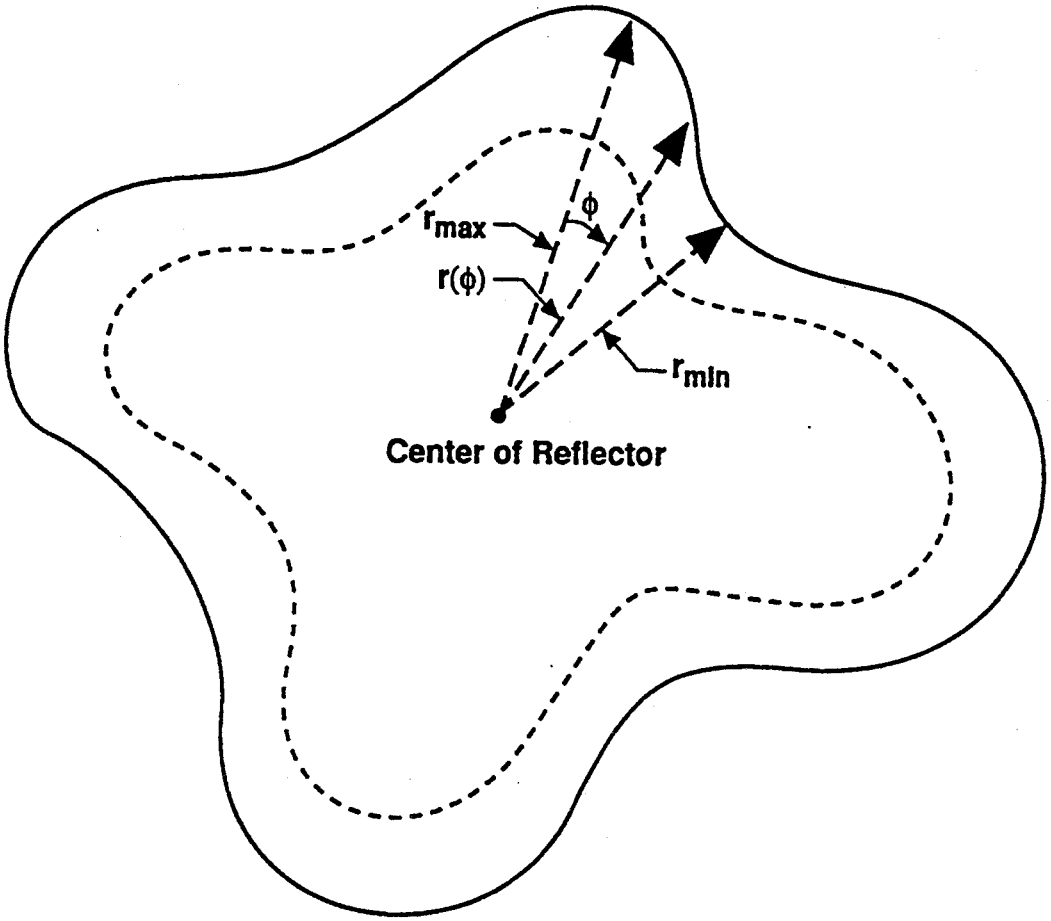
FIG. 18 illustrates serrations of a reflector and its transition geometry.

FIG. 16 graphs transition function T(X) versus X for various values of A. A value of A=0.8 was found to be best for a specific compact range design in which the reflector was a 75 ft. diameter, circular portion of an offset fed paraboloid with focal length of 150 ft., a transistion length of 15 ft. and 64 edge serrations. The low frequency limit for this design is 1.0 GHz. FIG. 17 illustrates how the variables $\phi$, $r(\phi)$, $r_{max}$ and $r_{min}$ are shown relative to an individual serration 16 on reflector 10 as shown in FIG. 1. FIG. 18 illustrates these same variables relative to an alternatively shaped reflector, as shown in FIG. 15.

As can be seen in FIG. 16, the general equation for the shape of one half of an edge serration is presented in terms of the transition function T(X). Let the angular width of one half of a serration (the region between the tip of the serration to one of its roots) be given by H and let the Cartesian coordinate along the edge of a serration be given by Y. Let Y=O at the tip of the serration and let Y=H at the root of the serration. The shape of a serration between the tip and one root is then given by the function:

$$X=T'(Y/H) \text{ for } O \leqq Y \leqq H$$

where T'(X/H) is the inverse of the transition function T(X) which can often be found in closed form, for closed form transition functions, and can be found numerically for other types of functions. It is noted that X=O for Y=O, which is the Cartesian coordinate of the tip of the serration, and X=L for Y=H is the Cartesian coordinate of the root of one half the serration. The shapes of serration halves can be the same or could have a different length L and/or a different half width H. Thus the serrations are not necessarily symmetric, nor do they necessarily have the same widths or lengths around the edge of the reflector. Each serration, however, uses the same transition function. A suggested minimal value of L is 10–15 wavelengths at the lowest operating frequency. A recommended range of H is between L/10 and L/4. The function given above for the edge serrations shape for the circular paraboloidal reflector is an example of uniform serrations using the raised cosine transition function.

In practice, the desired transition function is chosen based on the goal to be achieved in the performance of the reflector. That goal may be to lower existing sidelobe levels or to lower sidelobe levels in a specific angular region, or it may be to increase the efficiency of an antenna. The Goal may also be to achieve some compromise between antenna efficiency, antenna gain and sidelobe level for a fixed surface area or weight of reflector metal. Each desired reflector performance parameter can be varied by varying the edge transition function. The degree of control of the edge transition function is not infinite, but is considerable with respect to sidelobe level and antenna efficiency.

It is to be understood that the invention is not limited by the specific illustrative embodiment, but only by the scope of the appended claims.

I claim:

1. A method of optimizing surface currents within a transition region of a reflector surface characterized by an aperture field by using a plurality of identically shaped serrations having tips comprising the steps of:

selecting a number of serrations, and a length and width of each serration;

selecting a transition function for said transition region;

determining a shape of each serration by inverting the transition function and solving the equation:

$$r(\phi)=r_{min}+(r_{max}-r_{min})\cos^{-1}[2(\phi/360°/2N)^{1/A}-1]/\pi,$$

where $r(\phi)$ is the radius of one half of one of the identical serrations as a function of the angle $\phi$, with the radius and the angle both measured from the center of the reflector, $r_{min}$ is the radial distance from the center of the reflector to the beginning of the transition region, $r_{max}$ is the radial distance from the center of the reflector to the end of the transition region, N is the number of serrations, and A is a non-zero parameter; and forming said serrations having the selected length, width and shape within said transition region on said reflector surface.

2. The method of claim 1 wherein the step of selecting the transition function for said transition region includes solving the equation:

$$T(r)=(\tfrac{1}{2}[1+\cos(\pi(r-r_{min})/(r_{max}-r_{min}))])^A,$$

where r is the radial distance from the center of the reflector to a point between $r_{min}$ and $r_{max}$.

3. The method of claim 1 wherein the step of forming said serrations on said reflector surface includes forming said serrations as the edge of said reflector surface and in the continued shape of said reflector surface.

4. The method of claim 1 wherein the step of forming said serrations on said reflector surface includes cutting serrations having the selected shape and length in the transition region of said reflector.

5. The method of claim 3 wherein the step of forming said serrations on said reflector surface further includes truncating the tips of the serration.

6. The method of claim 5 wherein the step of truncating the tips of the serrations includes cutting off the tips of each said serrations.

7. A method for optimizing electromagnetic scattering in an off-axis direction of a reflector surface and enhancing electromagnetic scattering in an on-axis direction by using a plurality of identically shaped serrations on a transition region of the reflector surface, said method comprising the steps of:

selecting a number of serrations and a length and width of each serration;

selecting a transition function for said transition region;

determining a radial shape of each serration by inverting the transition function and solving the equation:

$$r(\phi)=r_{min}+(r_{max}-r_{min})\cos^{-1}[2(\phi/360°/2N)^{1/A}-1]/\pi,$$

where $r(\phi)$ is the radius of one half of one of the identical serrations as a function of the angle $\phi$ with the radius and the angle both measured from the center of said reflector, $r_{min}$ is the radial distance from the center of the reflector to the beginning of the transition region, $r_{max}$ is the radial distance from the center of the reflector to the end of the transition region, N is the number of serrations, and A is a non-zero parameter; and forming said serrations having the selected length, width and shape within said transition region on said reflector surface.

8. The method of claim 7 wherein the step of selecting the transition function for said transition region includes solving the equation:

$$T(r)=(\tfrac{1}{2}[1+\cos(\pi(r-r_{min})/(r_{max}-r_{min}))])^A,$$

where r is the radial distance from the center of the reflector to a point between $r_{min}$ and $r_{max}$.

9. The method of claim 7 wherein the number of serrations is within a range of 32 to 192 serrations.

10. The method of claim 9 wherein said selected length and width of each serration is varied randomly.

* * * * *